US006514356B2

(12) United States Patent
Vystrcil et al.

(10) Patent No.: US 6,514,356 B2
(45) Date of Patent: Feb. 4, 2003

(54) EDGE CLEANER FOR VACUUM CLEANER

(75) Inventors: Robert A. Vystrcil, Garrettsville, OH (US); Craig M. Saunders, Rocky River, OH (US); Cynthia M. Caffoe, Cleveland Heights, OH (US)

(73) Assignee: Royal Appliance Mfg. Co., Glenwillow, OH (US)

( * ) Notice: Subject to any disclaimer, the term of this patent is extended or adjusted under 35 U.S.C. 154(b) by 77 days.

(21) Appl. No.: 09/759,828

(22) Filed: Jan. 12, 2001

(65) Prior Publication Data

US 2002/0092125 A1 Jul. 18, 2002

(51) Int. Cl.[7] ..... B08B 5/04
(52) U.S. Cl. ..... 134/21; 15/373; 15/416
(58) Field of Search ..... 15/416, 373; 134/21

(56) References Cited

U.S. PATENT DOCUMENTS 1,567,432 A * 12/1925 English ..... 15/373
1,745,863 A * 2/1930 Owen ..... 15/373
2,047,677 A * 7/1936 Edstrom ..... 15/365
2,348,861 A * 5/1944 Smellie ..... 15/327.7
3,942,219 A 3/1976 Johnson
4,023,234 A * 5/1977 Martinec et al. ..... 15/331
4,222,146 A 9/1980 Hertzberg
4,776,059 A * 10/1988 Worwag ..... 15/331
4,959,885 A 10/1990 Sovis et al.
5,475,893 A 12/1995 Sepke
5,502,870 A 4/1996 Ragner et al.
5,768,745 A * 6/1998 Lee ..... 15/373
5,911,261 A 6/1999 Farone et al.
6,039,817 A 3/2000 Payne
6,094,776 A 8/2000 Fish

* cited by examiner

*Primary Examiner*—Chris K. Moore
(74) *Attorney, Agent, or Firm*—Fay, Sharpe, Fagan, Minnich & McKee, LLP

(57) ABSTRACT

An upright vacuum cleaner is disclosed, comprising an upright section (12) and a base (14) with primary nozzle (18), and further including an edge cleaner (40). The edge cleaner includes a main body (46) and brushes (50). The edge cleaner is rotatably mounted to the vacuum cleaner base (14) through hole (41) by fastener (42) and receptacle (44), and preferably includes a vacuum inlet (48). The edge cleaner (40) has an operational position in which the edge cleaner extends beyond an edge of base (14) and is engaged with the floor; and a stowed position in which the brushes are lifted off the floor, the vacuum inlet is disconnected from the vacuum suction, and the edge cleaner resides in a recess (57) of the base (14).

20 Claims, 7 Drawing Sheets

EDGE CLEANER FOR VACUUM CLEANER

BACKGROUND OF THE INVENTION

The present invention relates to vacuum cleaners, and more specifically to an upright vacuum cleaner with improved capability for cleaning floor edges and corners. However, it will be appreciated that the invention may additionally find application in a cleaning nozzle attachment of a canister-type vacuum cleaner or other vacuum cleaning apparatus, and its description in reference to an upright vacuum cleaner should not be construed as limiting the invention thereto.

The conventional upright vacuum cleaner is well known prior art. It is a single-piece portable vacuum cleaner including a base mounted on wheels, rollers, or the like, with a built-in nozzle whose opening is directed toward the floor for drawing debris therein; and an attached upright section usually containing at least an electrically powered means for generating vacuum suction, an air pathway connecting the nozzle with the vacuum suction, a filter to remove dirt and other debris drawn up into the nozzle and through the air pathway by the vacuum suction, an exhaust for ejecting the filtered air, and a handle for manually maneuvering the vacuum cleaner across the floor. The base is usually mechanically attached to the upright section by a hinge which improves vacuum cleaner maneuverability. Additional features often incorporated into commercial upright vacuum cleaners include a rotating brush or agitator near the nozzle opening for mechanically dislodging dirt, and a means for nozzle/base height adjustment to accommodate different flooring types such as thick rugs versus bare floors.

The upright vacuum cleaner has numerous advantages over other vacuum cleaner designs such as the canister system. These advantages include compactness, a convenient one-piece design, ease of operation, and a typically large vacuum footprint which is usually comparable to the floor area covered by the base.

However, upright vacuum cleaners suffer from some disadvantages, principally involving limited accessibility of the base/nozzle unit to confined areas such as floor edges and corners. A compromise solution is to incorporate into the upright vacuum cleaner an external vacuum suction orifice with associated detachable vacuum hose and cleaning attachments for vacuuming corners, furniture, walls, ceilings, and other hard-to-reach places. This design is essentially a hybrid between the upright vacuum cleaner and the canister system, and introduces the disadvantages of the latter. These disadvantages include the possibility of misplacing or losing accessories; the requirement for the operator to select, locate, and connect the appropriate attachment for each distinct cleaning task; and less compactness versus a conventional single-piece upright vacuum cleaner.

A second approach which addresses the floor edge and corner accessibility problem of the upright vacuum cleaner while potentially retaining its single-component design is to modify the nozzle/base design to direct a portion of the mechanical agitation and/or vacuum suction toward the side edges or corners of the base. U.S. Pat. No. 4,222,146 to Hertzberg, U.S. Pat. No. 5,475,893 to Sepke, U.S. Pat. No. 5,911,261 to Farone et al., and U.S. Pat. No. 6,094,776 to Fish, describe improved apparatus for mechanical agitation at the edges of the base through modified nozzle agitator design or additional auxiliary side brushes. In the Fish and Farone designs, the brushes are removable, while in the Sepke design a geared mechanism is provided to adjust the side brush position. Hertzberg teaches a modified nozzle agitator design which brings the agitator ends into close proximity to the base edge.

Improved suction at the edges is also provided at least in the Sepke invention by extending the nozzle opening to the extreme edges of the base. However, it will be noted that this extension distributes the vacuum suction over a larger total nozzle opening area and therefore will reduce the per-unit-area vacuum suction. Other designs for improved edge suction are described in U.S. Pat. No. 3,942,219 to Johnson and U.S. Pat. No. 6,039,817 to Payne, where in both designs valves are provided to selectively block off suction to the edge cleaners, thereby increasing the per-unit-area vacuum suction of the main nozzle when the edge cleaners are not in use.

The present invention contemplates an upright vacuum cleaner with an edge cleaner which provides easy operation and improved performance.

SUMMARY OF THE INVENTION

In accordance with one aspect of the present invention, an upright vacuum cleaner is disclosed, comprising: a handle for manually maneuvering the vacuum cleaner; a means for generating vacuum suction; a pathway into which an airflow is drawn by the suction means; a filter through which the airflow passes prior to exiting the vacuum cleaner, said filter acting to remove particles from the airflow; an exhaust though which the filtered airflow is discharged from the vacuum cleaner; a base; a vacuum nozzle contained within the base and connected to the suction means through the pathway; and an edge cleaner disposed at an edge of the base and including bristles for dislodging dirt and debris, the edge cleaner being adjustable into an operational position in which the bristles contact the floor beyond the edge of the base.

In accordance with another aspect of the present invention, an edge cleaner for a vacuum cleaner is disclosed, comprising: a main body having a vacuum inlet hole; and a fastener holding the main body to the vacuum cleaner base, the fastener enabling movement of the main body into: an operational position in which the vacuum inlet hole extends beyond the edge of the base and faces the floor and is further operatively connected to the vacuum suction, and a stowed position in which the vacuum inlet hole is operatively disconnected from the vacuum suction.

In accordance with yet another aspect of the present invention, in an upright vacuum cleaner having a base containing a primary air passageway through which a vacuum suction is pulled, a method for selectively extending cleaning action beyond an edge of the base is disclosed, the method comprising: brushing particles loose from the floor using a brush, the brush being permanently attached to the base, and further being selectively extendable into a position beyond the edge of the base and in operative contact with the floor.

One advantage of the present invention is that it provides an easy-to-use edge cleaner which is integral to the base and is selectively positioned beyond an edge of the base, thereby facilitating vacuuming at floor edges and especially at floor corners.

Another advantage of the present invention is that the vacuum cleaner may retain the one-piece design of conventional upright vacuum cleaners while still providing improved edge-cleaning capability.

Another advantage of the present invention is that the edge cleaner may be selectively stowed in a recess of the base when not in use.

Another advantage of the present invention is that vacuum suction is blocked off from the edge cleaner when the edge cleaner is in the stowed position, thereby directing full vacuum suction to the main nozzle of the vacuum cleaner when the edge cleaner is not in use.

Yet another advantage of the present invention is that the edge cleaner in the stowed position lies within a recess of the base, providing an aesthetically pleasing essentially continuous and essentially smooth base profile.

Still further advantages and benefits of the present invention will become apparent to those of ordinary skill in the art upon reading and understanding the following detailed description.

BRIEF DESCRIPTION OF THE DRAWINGS

The invention may take form in various components and arrangements of components. The drawings are only for the purposes of illustrating preferred embodiments and are not to be construed as limiting the invention.

DETAILED DESCRIPTION OF THE PREFERRED EMBODIMENTS

Figure 1:
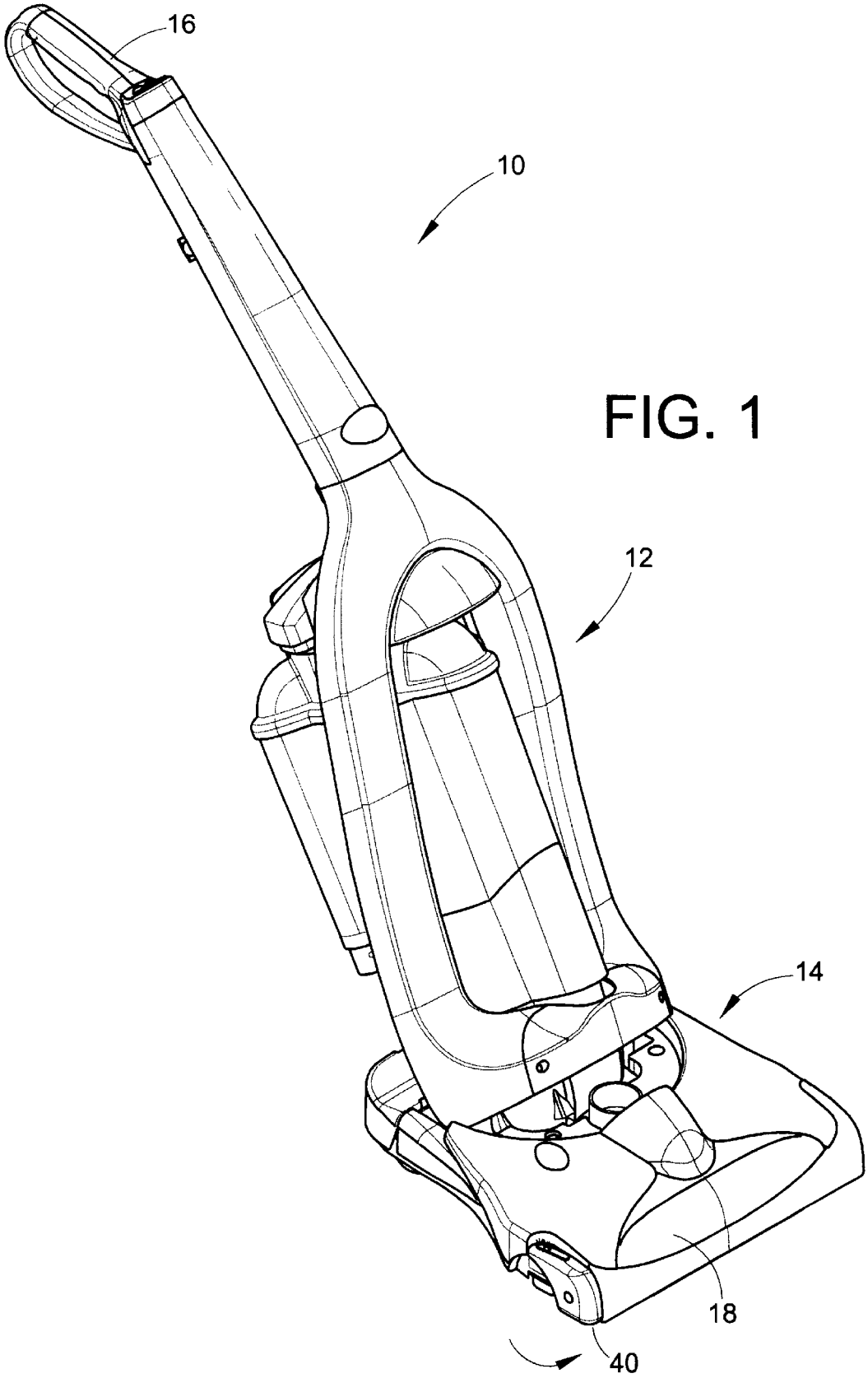
FIG. 1 is a perspective view of one embodiment of the upright vacuum cleaner with the edge cleaner in the stowed position.

With reference to FIGS. 1–4, the improved upright vacuum cleaner 10 is described. The upright vacuum cleaner 10 consists of an upright section 12 and a base section 14. The upright section includes a handle 16 to allow the user to maneuver the vacuum across the floor. The vacuum cleaner also includes other conventional components such as base wheels, rollers, castors, or the like; a means for generating a vacuum suction; one or more air filters for removing dirt and debris drawn up by the vacuum; and an air exhaust. The details of these conventional components are well within the understanding of one of ordinary skill in the art and need not be illustrated for an enabling disclosure of this invention.

The base includes at least a main nozzle 18 with an opening directed toward the floor such that vacuum suction pulled through the main nozzle will draw dust and debris up off the floor. The base 14 also includes an edge cleaner 40 shown retracted into the stowed position in FIGS. 1 and 3 and extended into the operational position in FIGS. 2 and 4. In the drawings only a single edge cleaner is shown at the right front of the base. However, other numbers of edge cleaners are also contemplated, such as two edge cleaners, one at each front corner of the base. It will be particularly noticed that in the operational position (FIGS. 2 and 4) the edge cleaner 40 extends beyond the edge of base 14, thereby providing improved edge cleaning.

The edge cleaner will be described in greater detail with continuing reference to FIGS. 1–4 and further reference to FIGS. 5 and 6. Edge cleaner 40 is rotatably mounted through hole 41 by fastener 42 and receptacle 44 to an edge of the base 14. The edge cleaner is preferably semi-rigidly locked into the operational or the stowed position by a locking mechanism. In the figures a locking boss 45 and associated receptacle recesses $\mathbf{45}_R$ are employed. Of course other locking mechanisms such as snaps, spring-loaded elements, or the like, may also be employed. Additionally, although a rotatable pivot mounting is illustrated, other movable fastening configurations, such as a sliding fastener whereby the edge cleaner may be extended into an operational position beyond an edge of the base by sliding action, are also contemplated and fall within the scope of the invention.

Edge cleaner 40 comprises a main body 46 having a vacuum inlet 48, a set of bristles 50, and an auxiliary air pathway 52. In the operational position (FIGS. 2 and 4) the vacuum inlet 48 and bristles 50 face down toward the floor. In this position the bristles 50 are in operative contact with the floor and serve to brush and dislodge dirt and debris as the vacuum cleaner is moved about the floor, and the vacuum inlet 48 suctions the dirt and debris into auxiliary air pathway 52. Vacuum suction is supplied to auxiliary air pathway 52 through main nozzle 18 via base orifice 54 and edge cleaner hole 56. In the operational position shown in FIGS. 2 and 4, base orifice 54 and edge cleaner hole 56 are essentially coaxial. Thus, a continuous vacuum path exists starting at vacuum inlet 48 and continuing into auxiliary air pathway 52, edge cleaner hole 56, and coaxial base orifice 54, the latter which connects directly to main nozzle 18.

Figure 2:
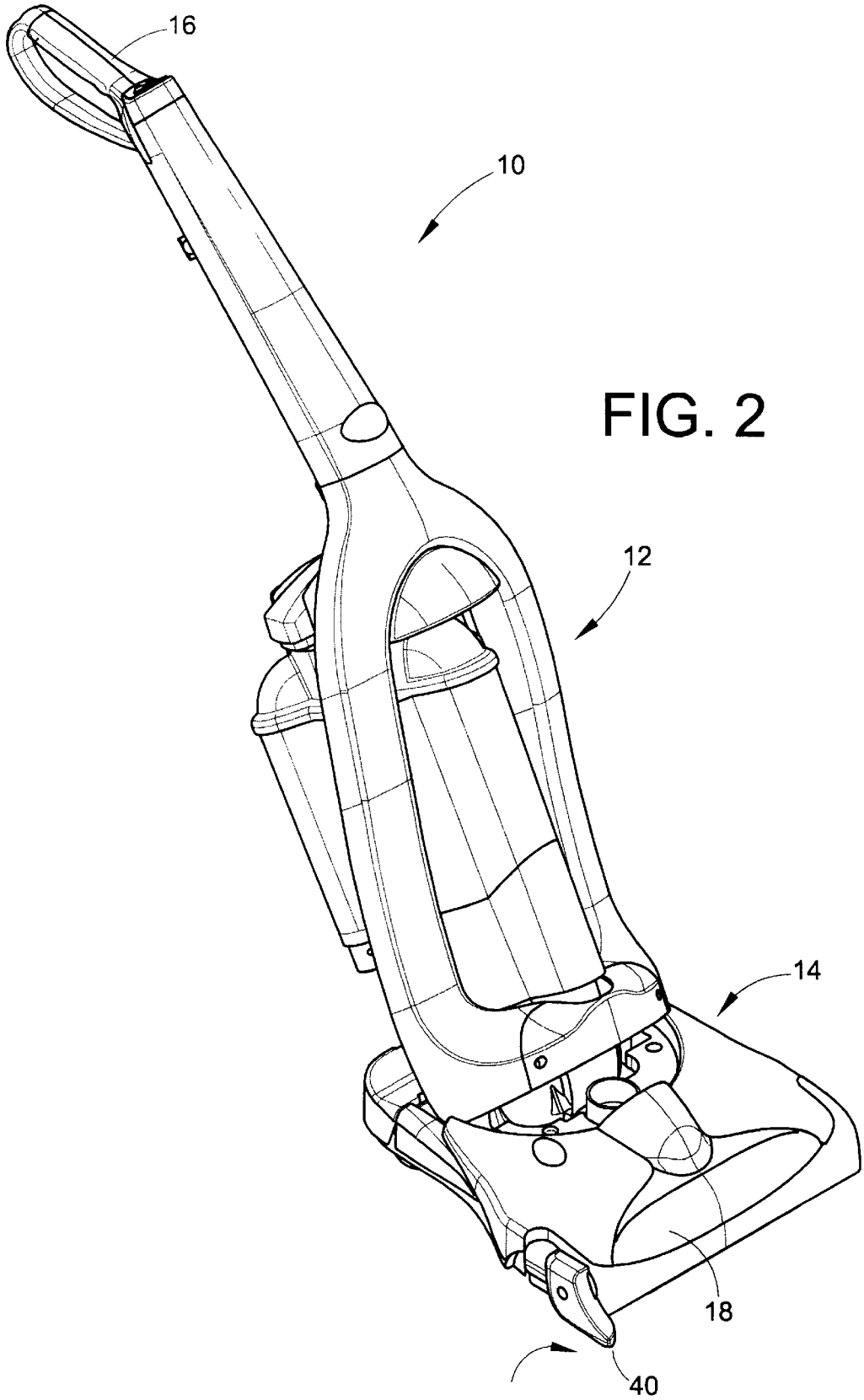
FIG. 2 is a perspective view of one embodiment of the upright vacuum cleaner with the edge cleaner in the operational position.
Figure 4:
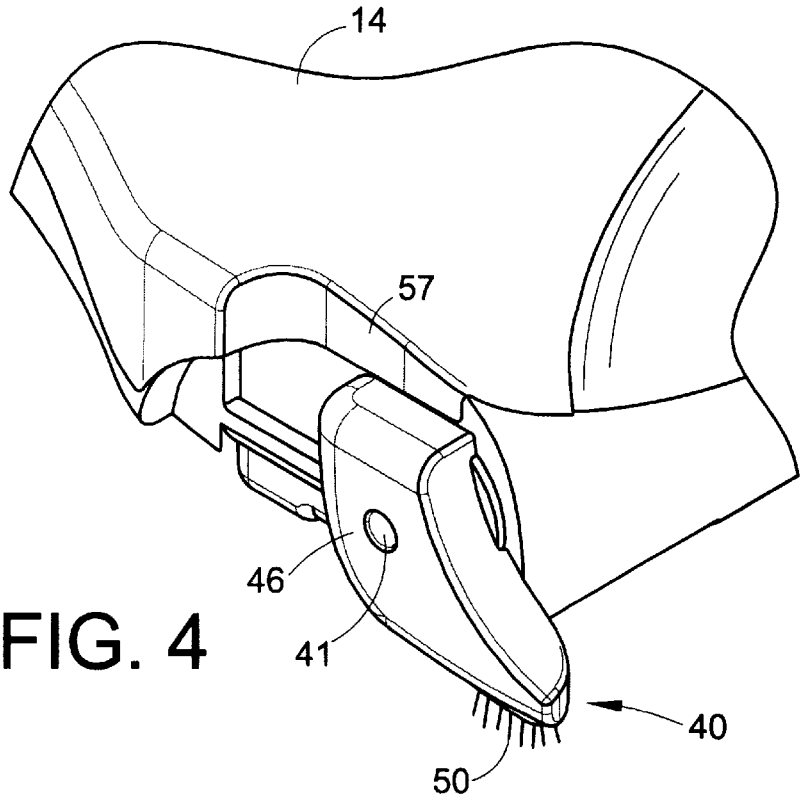
FIG. 4 is a perspective view of one embodiment of the edge cleaner mounted on the base in the operational position.
Figure 5:
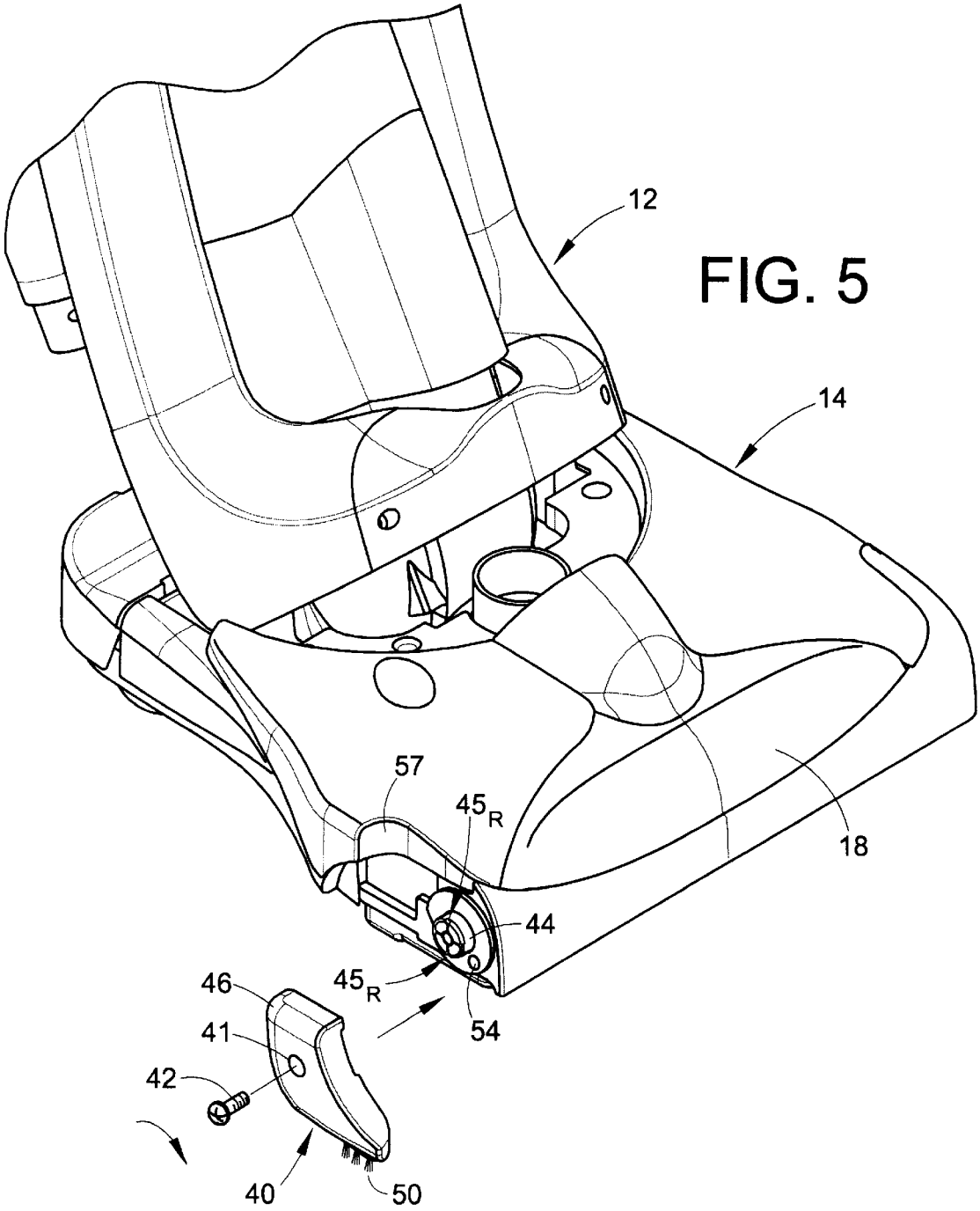
FIG. 5 is a perspective view of one embodiment of the upright vacuum cleaner which particularly illustrates the coupling of the edge cleaner to the base.

As shown especially in FIGS. 2 and 4, in the operational position the edge cleaner is positioned beyond the main body of the base. This positioning facilitates cleaning near floor edges and especially into corners. Prior art edge cleaners which are integral to the base are continuously molded into the base, and so the base prevents the edge cleaner from reaching completely into corners and edges.

Figure 3:
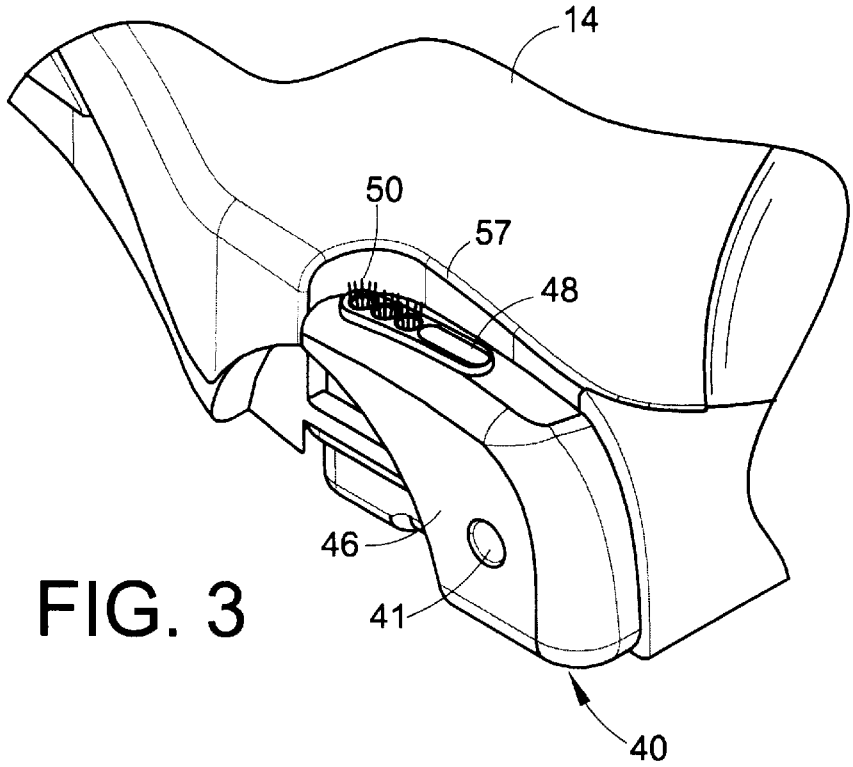
FIG. 3 is a perspective view of one embodiment of the edge cleaner mounted on the base in the stowed position.

When not in use, edge cleaner 40 may be rotated approximately 180° about the axis of fastener 42 into the stowed position as shown in FIGS. 1 and 3, where the edge cleaner is stowed in a recess 57 of the base 14. In the stowed position base orifice 54 is no longer coaxial with edge cleaner hole 56 and in fact there is no overlap at all between these two openings. An essentially vacuum-tight seal is formed between base orifice 54 and the main body 46 of the edge cleaner, so that the full vacuum suction is now applied to main nozzle 18. In the stowed position it is further pointed out that edge cleaner 40 and the base recess 57 are molded to form an aesthetically pleasing, essentially continuous base profile.

Figure 6:
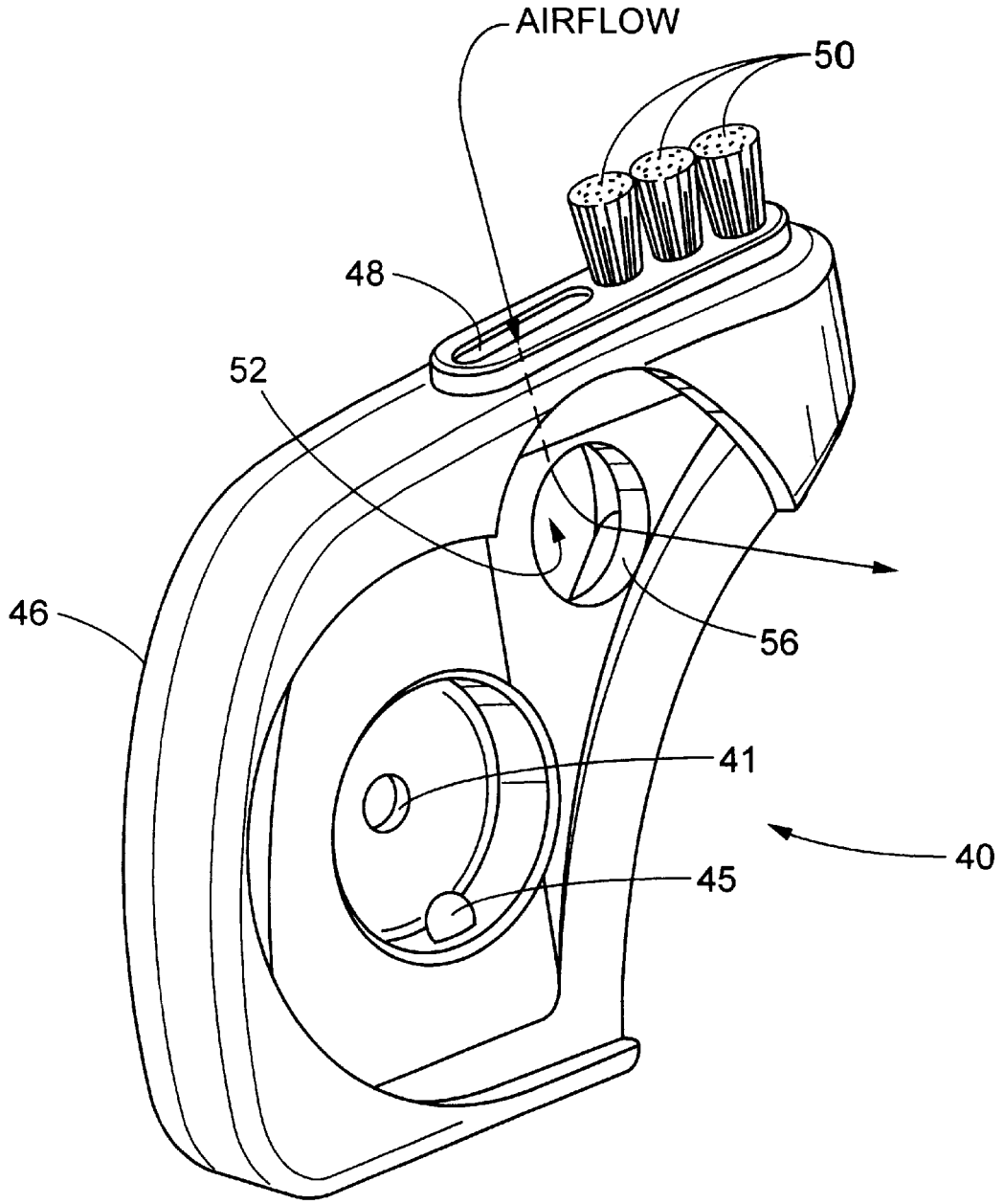
FIG. 6 is a perspective view of one embodiment of the edge cleaner viewed from the side facing the base.
Figure 7:
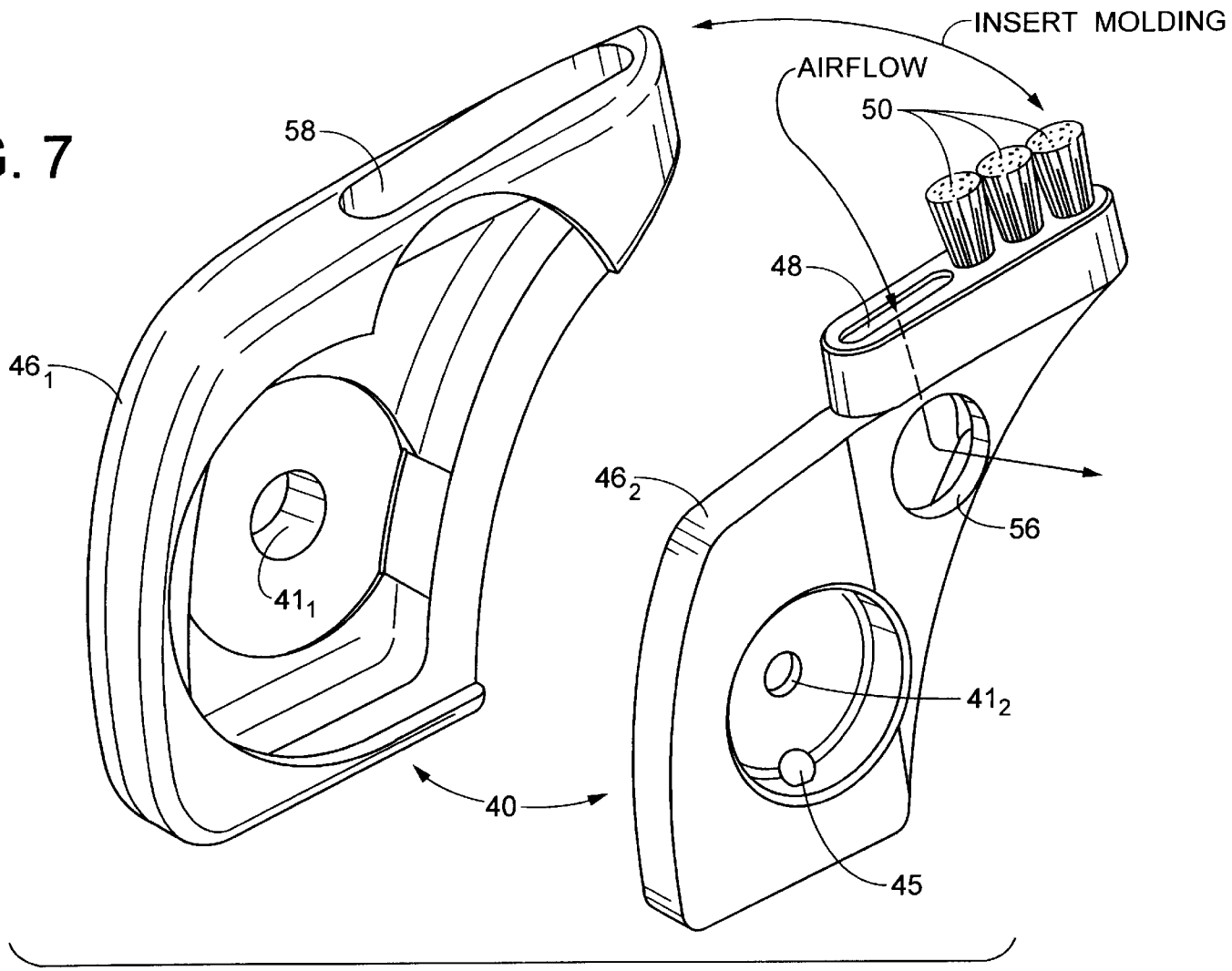
FIG. 7 is a perspective view of a second embodiment of the edge cleaner which includes a bumper guard.

The single-piece edge cleaner shown in FIG. 6 requires a compromise in material selection between a hard material for durability versus a softer material for protecting walls and objects from being damaged when bumped. FIG. 7 shows an alternate embodiment of edge cleaner 40, where the main body 46 of the single-piece edge cleaner is replaced by two pieces, $\mathbf{46}_1$ and $\mathbf{46}_2$. Piece $\mathbf{46}_2$ inserts securely into bumper guard $\mathbf{46}_1$ and are together pivotally mounted through holes $\mathbf{41}_1$ and $\mathbf{41}_2$. In this embodiment, piece $\mathbf{46}_2$ may be manufactured using a hard material while bumper guard $\mathbf{46}_1$ is made of a softer material and serves to cushion impacts between the edge cleaner and walls, furniture legs, and other household items which are frequently bumped when vacuuming confined spaces. Bumper guard $46_1$ includes an oblong opening 58 through which vacuum inlet 48 and bristles 50 operate.

Figure 8:
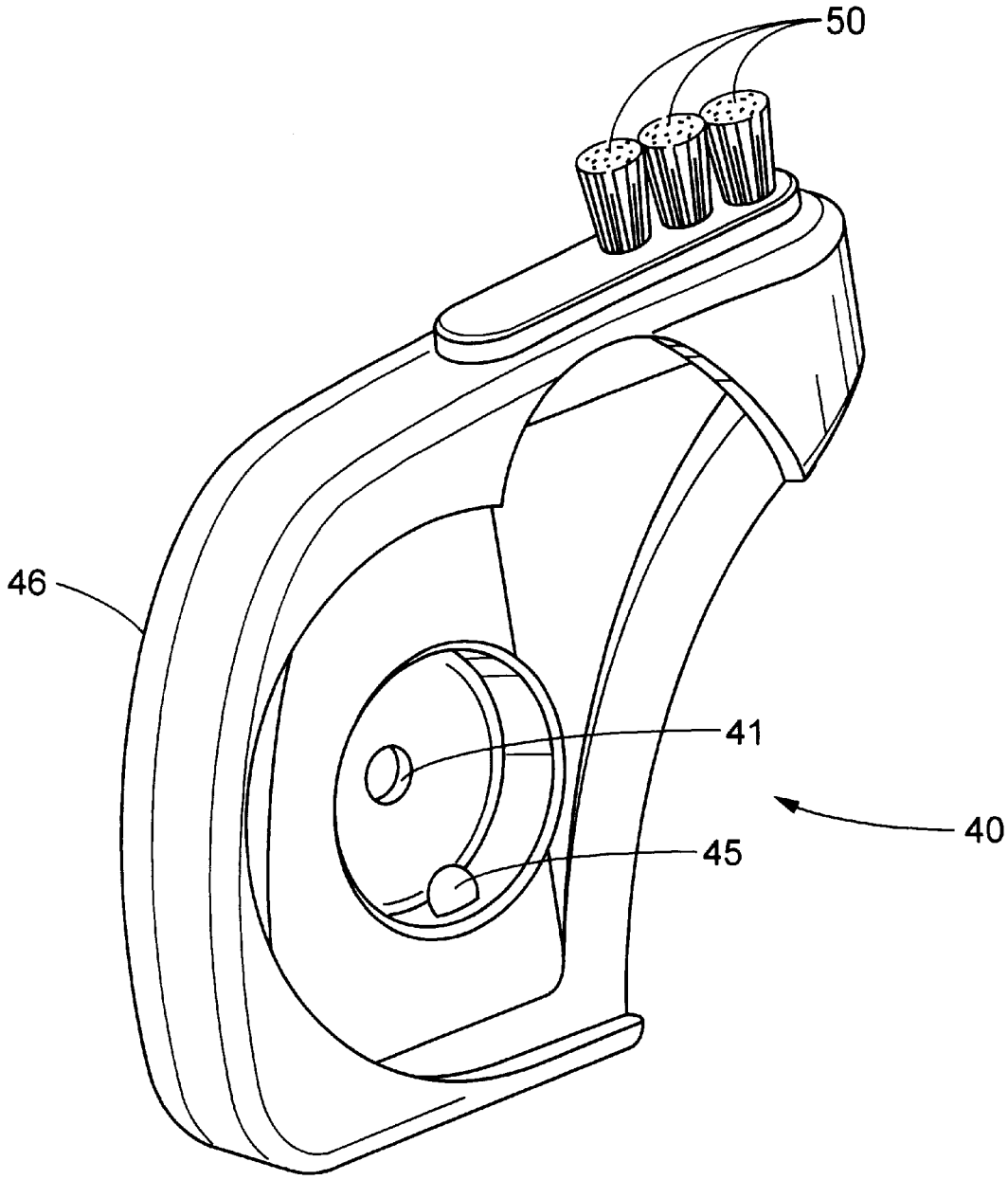
FIG. 8 is a perspective view of a third embodiment of the edge cleaner, which does not include vacuum capability, viewed from the side facing the base.

Another alternate embodiment of the invention is shown in FIG. 8, where the vacuum path comprised of vacuum inlet 48, auxiliary air pathway 52, and edge cleaner opening 56 are eliminated, thereby simplifying manufacturing. Base orifice 54 optionally may be present when the alternate edge cleaner embodiment of FIG. 8 is employed. Such a case may arise where edge cleaners of the types shown in FIGS. 6, 7, and 8 are optional components for a commercial upright vacuum cleaner. In the alternate embodiment of FIG. 8, main body 46 therefore is preferably formed to provide a vacuum seal with respect to base orifice 54 when the edge cleaner is in either the stowed or operational position.

The invention has been described with reference to the preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiments, the invention is now claimed to be:

1. An upright vacuum cleaner comprising:

a handle for manually maneuvering the vacuum cleaner;

a means for generating vacuum suction;

a pathway into which an airflow is drawn by the suction means;

a filter through which the airflow passes prior to exiting the vacuum cleaner, said filter acting to remove particles from the airflow;

an exhaust through which the filtered airflow is discharged from the vacuum cleaner;

a base;

a vacuum nozzle contained within the base and connected to the suction means through the pathway; and an edge cleaner disposed at an edge of the base and including bristles for dislodging dirt and debris, the edge cleaner being adjustable into an operational position in which the bristles contact the floor beyond the edge of the base, wherein the bristles of the edge cleaner when in the operational position are positioned slightly in front of the base.

2. The vacuum cleaner as specified in claim 1 wherein the edge cleaner is adjustable into a stowed position.

3. The vacuum cleaner as specified in claim 2, wherein the edge cleaner when in the stowed position lies within a recess of the base such that the base and the edge cleaner together form an approximately continuous shape.

4. The vacuum cleaner as specified in claim 2 wherein the edge cleaner is rotatably mounted to the base, said adjusting into operational and stowed positions being made by appropriate rotation of the edge cleaner.

5. The vacuum cleaner as specified in claim 2 wherein:

the edge cleaner mounting to the base incorporates a slider;

said adjusting into the operational position is achieved by sliding the edge cleaner beyond the edge of the base; and said adjusting into the stowed position is achieved by sliding of the edge cleaner toward the base.

6. The vacuum cleaner as specified in claim 2 in which the edge cleaner includes a vacuum inlet hole which in the operational position faces the floor, and which in the operational position is furthermore operatively connected to the suction means through the vacuum nozzle.

7. The vacuum cleaner as specified in claim 6 in which the edge cleaner is operatively disconnected from the suction means when in the stowed position.

8. The vacuum cleaner as specified in claim 1, wherein the number of edge cleaners is two, the first located near the left front corner of the base, and the second located near the right front corner of the base.

9. The vacuum cleaner as specified in claim 1, wherein the cleaner is located near a front corner of the base.

10. The vacuum cleaner as specified in claim 1, wherein the edge cleaner further includes a bumper guard comprises of a soft material and substantially covering the exposed outer surface of the edge cleaner.

11. An edge cleaner for a vacuum cleaner, comprising:

a main body having a vacuum inlet hole; and a fastener holding the main body to a vacuum cleaner base, the fastener enabling movement of the main body into:

an operational position in which the vacuum inlet hole extends beyond the edge of the vacuum cleaner base and faces the floor and is further operatively connected to a suction source, and a stowed position in which the vacuum inlet hole is operatively disconnected from the suction source.

12. The edge cleaner as specified in claim 11, wherein the main body further includes bristles which contact the floor beyond the edge of the base when the main body is in the operational position.

13. The edge cleaner as specified in claim 11, in which the fastener is a pivot and the movement of the main body is by rotation about the pivot.

14. The edge cleaner as specified in claim 13, wherein the operational position is obtained from the stowed position by rotating the edge cleaner approximately 180° about the pivot.

15. The edge cleaner as specified in claim 11, further including a bumper guard into which the main body is inserted.

16. The edge cleaner of claim 15, wherein said bumper guard comprises of a soft material and covers at least a portion of an exposed outer surface of the edge cleaner.

17. In an upright vacuum cleaner having a base containing a primary air passageway through which a vacuum suction is pulled, a method for selectively extending cleaning action beyond an edge of the base, the method comprising:

brushing particles loose from the floor using a brush, the brush being permanently attached to the base, and further being selectively extendable into a position beyond the edge of the base and in operative contact with the floor;

suctioning particles dislodged by the brushing through an auxiliary air passageway into the primary air passageway of the vacuum cleaner, the auxiliary air passageway being permanently attached to the base, and further being selectively extendable beyond the edge of the base and suctioning therebeyond.

18. The method for selectively extending cleaning action beyond an edge of the base as specified in claim 17, the brush further being selectively retractable into a stowed position wherein the brush is contained within a recess of the base and the auxiliary air passageway is operatively disconnected from the primary air passageway.

19. The method for selectively extending cleaning action beyond an edge of the base as specified in claim 18, wherein the selective extension and retraction is obtained by rotating the brush through an angle about a pivot.

20. The edge cleaner of claim 11, wherein the edge cleaner when in the stowed position lies within a recess of the vacuum cleaner base such that the base and the edge cleaner together form an approximately continuous shape.

* * * * *